US005406653A

United States Patent [19]

Todor

[11] Patent Number: 5,406,653

[45] Date of Patent: Apr. 18, 1995

[54] ADJUSTABLY INFLATABLE BODY CRADLE FOR USE IN WATER

[76] Inventor: Francis A. Todor, 903 NW. Carol, Grants Pass, Oreg. 19726

[21] Appl. No.: 219,365

[22] Filed: Mar. 29, 1994

[51] Int. Cl.[6] ..... B63B 7/08

[52] U.S. Cl. ..... 4/496; 4/571.1; 441/40; 441/130

[58] Field of Search ..... 441/40, 129, 130; 5/454, 455, 456; 4/496, 547, 559, 571.1, 573.1, 588

[56] References Cited

U.S. PATENT DOCUMENTS

| | | | |
|---|---|---|---|
| 1,829,137 | 10/1931 | Harris . | |
| 2,623,574 | 12/1952 | Damsch | 155/47 |
| 3,030,640 | 4/1962 | Gosman | 5/349 |
| 3,411,164 | 11/1968 | Sumergrade | 5/454 |
| 3,605,138 | 9/1971 | Tucker | 5/455 |
| 4,190,286 | 2/1980 | Bentley | 5/454 |
| 4,775,346 | 10/1988 | Gunter et al. | 441/129 |
| 4,876,756 | 10/1989 | Vaccaro . | |
| 5,020,168 | 6/1991 | Wood | 4/573.1 |
| 5,088,723 | 2/1992 | Simmons | 441/130 |
| 5,176,554 | 1/1993 | Simmons | 441/129 |
| 5,324,221 | 6/1994 | Kaufman et al. | 441/129 |

FOREIGN PATENT DOCUMENTS

| | | | |
|---|---|---|---|
| 2373996 | 8/1978 | France | 5/456 |

*Primary Examiner*—Henry J. Recla
*Assistant Examiner*—Charles R. Eloshway
*Attorney, Agent, or Firm*—Jacobson, Price, Holman & Stern

[57] ABSTRACT

An elongated flexive cradle is provided including longitudinally spaced and variably inflatable head, lower back and thigh cushions. At least the lower back and thigh cushions are adjustably shiftable longitudinally of the cradle and remote operable hand acutatable inflation/deflation structure is operatively associated with the cushions for individual adjustable inflation and deflation thereof by a person disposed on the cradle in a reclining position thereon when the cradle is disposed generally parallel and closely beneath the surface of a body of water.

8 Claims, 2 Drawing Sheets

ADJUSTABLY INFLATABLE BODY CRADLE FOR USE IN WATER

BACKGROUND OF THE INVENTION

1. Field of the Invention

This invention relates to an upwardly opening arcuate structure including longitudinally spaced opposite end and center adjustably inflatable cushions. The structure is designed to cradle a human body from the head thereof to the knees thereof with one of the end cushions disposed beneath the head of the user, the center cushion disposed beneath the lower back portion of the user and the other end cushion disposed beneath the lower thigh area of the user. The cushions are independently variably inflatable through the utilization of a palm-type hand pump and control valve assembly which is readily operable by one hand of the user when the user is in an inclined position supported from the cradle structure and without the user having to view the hand pump and valve assembly. By this type of construction the adjustably inflatable cushions may be inflated precisely to support the user in a mostly submerged but slightly upwardly buoyed position within a body of water, which body of water may be still or have variable currents effected therein.

2. Description of Related Art

Various different forms of adjustably inflatable structures for supporting the human body heretofore have been provided such as those disclosed in U.S. Pat. Nos. 1,829,137, 2,623,574, 3,030,640, 4,775,346 and 4,876,756. However, these previously known devices do not include the overall combination of structural and operational features of the instant invention.

SUMMARY OF THE INVENTION

A pair of laterally spaced apart, elongated and generally horizontally disposed upwardly opening and arcuate side members are provided and adjustably inflatable head, lower back and thigh cushions are disposed between and spaced apart longitudinally of the side members with the cushions each having remote marginal portions anchored relative to corresponding adjacent longitudinally spaced portions of the side members for support of the cushions from the side members. In addition, at least two of the cushions have their aforementioned remote marginal portions anchored relative to the side members for adjustable shifting therealong.

Further, a palm-type hand pump is operatively associated with each of the cushions for adjustable inflation and deflation thereof in order that the amount of air inflation enjoyed by each cushion may be precisely that amount so as to only slightly buoy up an associated user's body.

The main object of this invention is to provide an apparatus usable by persons of all statures in providing minimal buoyancy support to the head, lower back and lower thigh portions of persons in a body of water or similar specific gravity liquid whereby such persons may experience complete relaxation.

Another object of this invention is to provide buoyancy support structure in accordance with the preceding object and wherein the supported person may have his or her ears supported immediately above or immediately below the surface of the associated body of liquid.

Another important object of this invention is to provide a buoyancy structure which will be capable of providing minimal buoyancy and stability to persons substantially fully immersed within a whirlpool bath or the like.

Yet another object of this invention is to provide a buoyancy structure including a plurality of buoyancy sections which each may be variably inflated or deflated by the user while the same is supported from the buoyancy structure.

Another object of this invention is to provide a buoyancy structure which may be readily mounted by an ambulatory person as well as readily placed beneath a disabled person.

A final object of this invention to be specifically enumerated herein is to provide a device in accordance with the preceding objects and which will conform to conventional forms of manufacture, being of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
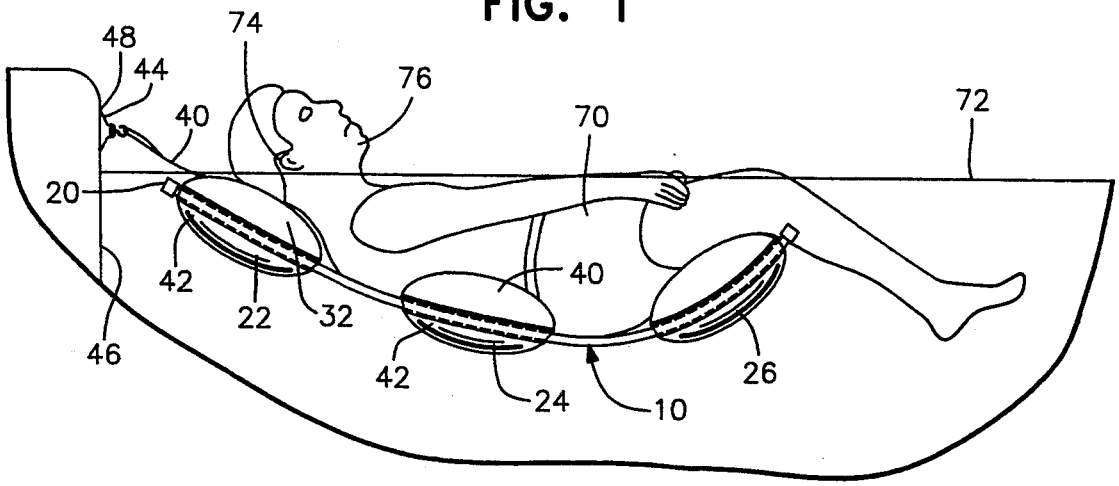
FIG. 1 is a side elevational view of the buoyancy device in use within a body of water and with the body of the user cradled thereon.
Figure 3:
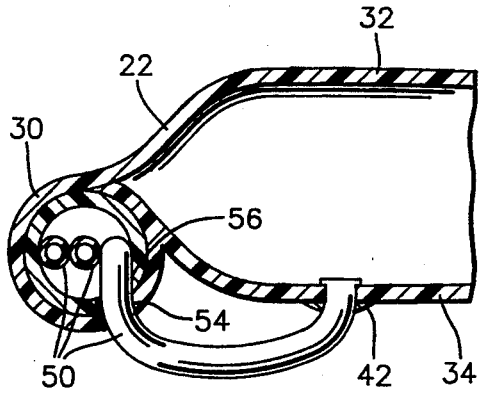
FIG. 3 is an enlarged fragmentary vertical sectional view taken substantially upon the plane indicated by the section line 3—3 of FIG. 2.
Figure 4:
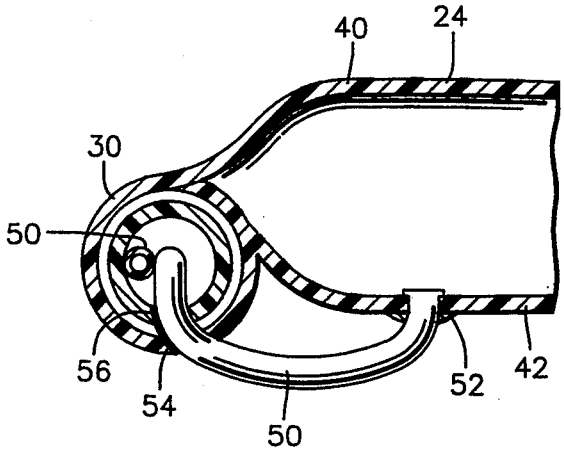
FIG. 4 is an enlarged fragmentary vertical sectional view taken substantially upon the plane indicated by the section line 4—4 of FIG. 2.

Referring now more specifically to the drawings the numeral 10 generally designates the buoyancy device or body cradle of the instant invention. The cradle 10 includes a pair of elongated horizontally laterally spaced apart and flexive longitudinal side members 12 and 14 which each comprise a section of plastic tubing.

One pair of corresponding ends of the side members 12 and 14 are capped as at 16 and 18 and the remote end of the side member 12 is capped as at 20.

Three adjustably inflatable head, lower back and thigh cushions 22, 24 and 26 are disposed and comprise the only structural connections between the side members and include remote margin tubular hems or anchor means 28 and 30 through which the corresponding side members 12 and 14 are received. The hems 28 and 30 of the cushion 22 reasonably tightly engage the side members 12 and 14 in order to prevent shifting of the head cushion 22 longitudinally of the side members 12 and 14. However, the tubular hems 28 and 30 of the lower back and lower thigh cushions 24 and 26 loosely receive the side members 12 and 14 therethrough in order that the cushions 24 and 26 may be adjustably shifted longitudinally of the side members 12 and 14. However, the looseness of the tubular hems 28 and 30 of the cushions 24 and 26 is not so extreme to allow unwanted longitudinal shifting of the cushions 24 and 26 longitudinally of the side members 12 and 14.

Figure 2:
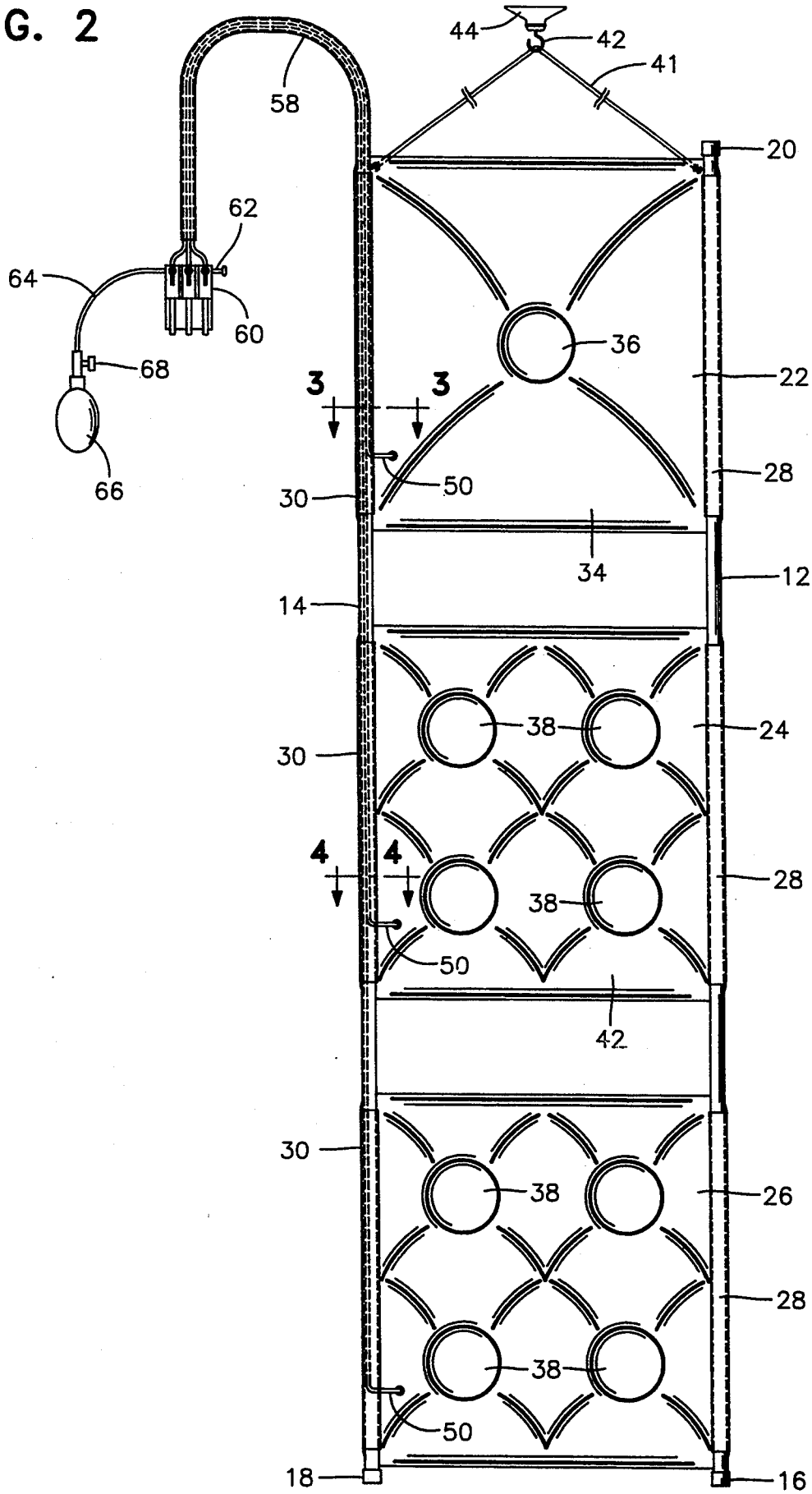
FIG. 2 is a bottom plan view of the buoyancy device on an enlarged scale.

As may be seen from FIG. 2 the head cushion 22 includes a center area where the top and bottom panels 32 and 34 are joined relative to each other and this area 36 of the head cushion 22 thereby defines a center upwardly opening recess in which to cradle the back of the user's head. On the other hand, the cushions 24 and 26 each include four corner areas 38 in which the top and bottom panels 40 and 42 thereof are joined together. In this manner, the upper surfaces of the cushions 24 and 26 include a plurality of uppermost surface areas thereof spaced thereover upon which to engage the lower back and lower thighs of the user.

The head cushion 22 includes a flexible bridle 41 whose opposite end portions are anchored relative to the corner portions of the cushion 22 remote from the cushion 24 and the longitudinal central portion of the bridle 41 has an anchor hook 42 of a suction cup 44 engaged therewith by which the cradle 10 may be anchored to a pool or whirlpool side wall 46 as at 48, see FIG. 1.

Each of the pillows 22, 24 and 26 has one end of an inflation/deflation flexible hose 50 opening thereinto in a fluid tight sealed manner as at 52 and each hose 50 is loosely received through a bore 54 formed in the underside of the corresponding tubular hem 30. Thereafter, each hose 50 extends through an elongated longitudinally extending slot 56 formed in an adjacent portion of the corresponding tubular side member 14 and thereafter extends through the tubular longitudinal side member 14 and exits the end thereof remote from the cushion 26. Each hose then passes through a tubular covering 58 and is sealingly connected to a valve body 60 including a reciprocal control 62. Also connected to the valve body 60 through the use of an inflation and deflation tube 64 is a bulb type hand pump 66 including a manually controllable check and vent valve assembly 68.

When it is desired to adjust the inflation of an individual cushion, the control 62 is longitudinally shifted to a position communicating the corresponding tube 50 with the tube 64 through the valve 60 (while the check and vent valve assembly 68 is closed). Then, the hand pump 66 may be alternately squeezed and released in order to pump air into the selected cushion to be inflated. After each cushion has been slightly over inflated, a person 70 may position his or her self on the cradle 10 (in a manner to be hereinafter more described) in the position indicated in FIG. 1. Then, the control may be selectively shifted to successively communicate each of the tubes 50 with the tube 64 and the check and vent valve assembly 68 may be actuated to deflate successive cushions the desired amount in order that the person 70 may be substantially fully submerged in the position illustrated in FIG. 1. When the person 70 is positioned as illustrated in FIG. 1 relative to the surface 72 of the water in which the cradle 10 is disposed, the person's ears 74 are elevated above the surface 72 and the person 70 may thus hear even faint above water sounds. However, if the person 70 wishes to block all but high volume sounds, the cushion 24 may be slightly more inflated and the cushion 22 may be slightly deflated, thus straightening out the back of the person 70 and lowering the person's head 76 to a position with the ears 74 beneath the surface 72.

In order to adjust the spacing of the cushions 22, 24 and 26 according to the individual person 70 to be disposed on the cradle 10, the cushions 24 and 26 may be gripped adjacent the tubular hems 28 and 30 thereof and pulled along the side members 12 and 14 to the desired positions thereof before the person 70 is positioned on the cradle 10.

If the cradle 10 is to be placed beneath a disabled person, the cushions 22, 24 and 26 initially will be not as greatly inflated in order that one attendant may manually depress the cradle 10 beneath the surface 72 while another attendant supports the person 70 at the level 72 and moves the person 70 over the submerged cradle. Then, one of the attendants may operate the control 60 as well as the hand pump 66 in order to obtain proper inflation of the cushions 22, 24 and 26.

If the person 70 is not disabled, he or she may vary the inflation of the cushions 22, 24 and 26 by operating the control 60 and the hand pump 66 as well as the combined check and vent valve assembly 68 while in a position disposed on the cradle 10. Furthermore, the suction cup 14 may be utilized to maintain the cradle 10 in generally the same position within a pool or whirlpool bath in the manner illustrated in FIG. 1.

If the person 70 is disposed in reasonably shallow water and is not disabled, he or she may readily "mount" the cradle 10 merely by standing erect with the cradle 10 disposed rearwardly. Then, the person 10 may grasp the side members 12 and 14 with his or her opposite hands to push the cradle 10 downwardly and beneath the person 70 as that person leans backward upon the cradle 10. Of course, once the cradle 10 has been positioned relative to the person 70 as illustrated in FIG. 1 of the drawings, the cradle 10 is prevented from longitudinal shifting relative to the person 10 by engagement of the pillow 26 beneath the lower thighs of the person 70 and the pillow 24 beneath the lower back of the person 70.

The foregoing is considered as illustrative only of the principles of the invention. Further, since numerous modifications and changes readily will occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An adjustably inflatable body cradle having opposite ends and including a pair of elongated, horizontally, laterally spaced apart and flexive longitudinal side members, separate adjustably inflated head, lower back and thigh cushions disposed between and spaced apart longitudinally of said side members, anchor means anchoring remote marginal portions of each of said cushions to corresponding adjacent longitudinally spaced portions of said side members, and inflation means for adjustably inflating said cushions, the spacing between said cushions being adjustable to the stature of a user of said cradle to substantially center the head of said user on said head cushion, the lower back area of said user on said lower back cushion and the rear thigh portions of said user on said thigh cushion, said anchor means adjustably anchoring said remote marginal portions of said lower back and thigh cushions to the adjacent side members for adjusted positioning lengthwise therealong.

2. The cradle of claim 1 wherein said cushions include corresponding upper sides, the upper side of said head cushion including a central upward opening recess.

3. The cradle of claim 1 wherein said side members are arcuate in shape and open upwardly.

4. The cradle of claim 1 including an elongated flexible tether member connected between said cradle and a suction cup for anchoring said cradle to a smooth unbroken surface.

5. An adjustably inflatable body cradle having opposite ends and including a pair of elongated, horizontally, laterally spaced apart and flexive longitudinal side members, separate adjustably inflated head, lower back and thigh cushions disposed between and spaced apart longitudinally of said side members, anchor means anchoring remote marginal portions of each of said cushions to corresponding adjacent longitudinally spaced portions of said side members, and inflation means for adjustably and separately inflating each cushion, the spacing between said cushions being adjustable to the stature of a user of said cradle to substantially center the head of the body of said user disposed on said cradle on said head cushion, the lower back area of said user on said lower back cushion and the rear thigh portions of said user on said thigh cushion, one of said side members being tubular, said inflation means including a flexible inflation/deflation hose for each of said cushions, each of said hoses including a first end sealingly opening into a corresponding cushion, a second end sealingly communicated with an air pump and vent valve through a control valve selectively actuatable to communicate a selected hose of said hoses with said air pump and a longitudinally extending slot extending through said one side member from adjacent a corresponding cushion outwardly to an end of said one side member remote from said thigh cushion.

6. The cradle of claim 5 wherein said anchor means include means anchoring said remote marginal portions of said lower back and thigh cushions to the adjacent side members for adjustable positioning lengthwise therealong.

7. The cradle of claim 6, an elongated flexible tether member anchored to the end of said cradle adjacent said head cushion and suction cup means supported from said tether member for removable suction anchoring to a smooth unbroken surface.

8. The cradle of claim 7 wherein said cushions include corresponding upper sides, the upper side of said head cushion including a central upward opening recess.

* * * * *